US011547619B1

(12) United States Patent
Alexander et al.

(10) Patent No.: US 11,547,619 B1
(45) Date of Patent: Jan. 10, 2023

(54) MOBILITY CART SYSTEM AND METHOD OF USE

(71) Applicants: James Edward Alexander, Abilene, TX (US); Scott Wofford, Abilene, TX (US); Sam Hunt, Anson, TX (US)

(72) Inventors: James Edward Alexander, Abilene, TX (US); Scott Wofford, Abilene, TX (US); Sam Hunt, Anson, TX (US)

( * ) Notice: Subject to any disclaimer, the term of this patent is extended or adjusted under 35 U.S.C. 154(b) by 0 days.

(21) Appl. No.: 17/018,909

(22) Filed: Sep. 11, 2020

Related U.S. Application Data

(60) Provisional application No. 62/928,127, filed on Oct. 30, 2019.

(51) Int. Cl.
*A61G 5/10* (2006.01)
*A61G 5/04* (2013.01)

(52) U.S. Cl.
CPC ..... *A61G 5/10* (2013.01); *A61G 5/04* (2013.01)

(58) Field of Classification Search
CPC ..... A61G 5/10; A61G 5/04; A61G 5/08
See application file for complete search history.

(56) References Cited

U.S. PATENT DOCUMENTS 3,937,489 A * 2/1976 Hawes ..... B62K 27/04 280/204
4,572,536 A * 2/1986 Doughty ..... A61G 5/10 280/304.1
6,186,528 B1 * 2/2001 Walker, Sr ..... A61G 5/10 280/204
9,365,254 B1 * 6/2016 Durrett ..... B62K 13/06
2004/0251658 A1 * 12/2004 Hagan ..... B62D 63/062 280/424
2007/0215661 A1 * 9/2007 Caplan ..... A61G 5/10 224/407
2007/0279203 A1 * 12/2007 Thomas ..... B60C 23/0472 340/447
2008/0023052 A1 * 1/2008 Barreiro ..... A45B 23/00 135/16
2012/0001403 A1 * 1/2012 Wydner ..... B60D 1/155 280/415.1
2016/0302982 A1 * 10/2016 Blankenship ..... A61M 5/1415
2017/0050481 A1 * 2/2017 Bidwell ..... B60D 1/246
2017/0334500 A1 * 11/2017 Jarek ..... G06F 3/0482
2018/0014988 A1 * 1/2018 Diaz-Flores ..... A61G 5/04
2019/0054972 A1 * 2/2019 Meehan ..... B62K 5/023
2019/0118588 A1 * 4/2019 Lesesky ..... G01S 19/13
2021/0059891 A1 * 3/2021 Raja ..... B60K 1/00
2021/0061396 A1 * 3/2021 Wada ..... B62K 5/007
2021/0371038 A1 * 12/2021 Zeng ..... B62K 21/12

* cited by examiner

*Primary Examiner* — Jacob D Knutson
*Assistant Examiner* — Conan D Duda
(74) *Attorney, Agent, or Firm* — Leavitt Eldredge Law Firm

(57) ABSTRACT

A mobility cart system includes a first platform with a plurality of wheels extending therefrom and configured to engage with a ground surface; a first control console with a first support attached to and extending from the first platform; a first seat attached to and extending from the first platform; and a power source to provide traversing movement of the first platform via the plurality of wheels; the first platform is to support a first user.

4 Claims, 5 Drawing Sheets

MOBILITY CART SYSTEM AND METHOD OF USE

BACKGROUND

1. Field of the Invention

The present invention relates generally to personal transportation systems, and more specifically, to a mobility cart that includes numerous adjustments for the user to customize based on their needs.

2. Description of Related Art

Personal transportation systems are well known in the art and are effective means to aid individuals in traveling from one location to another. For example, it is common for users to use bikes, standing scooters, seated scooters, and the like to get from one location to another. There is room for improvement in personal transportation systems, as it is desirable to have features such as cargo capacity, environmental friendliness, multiple rider capabilities, and ease of storage and transportation of the system. Accordingly, these are some of the features incorporated into the present invention, to provide for an improved mobility cart system.

Accordingly, although great strides have been made in the area of transportation systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
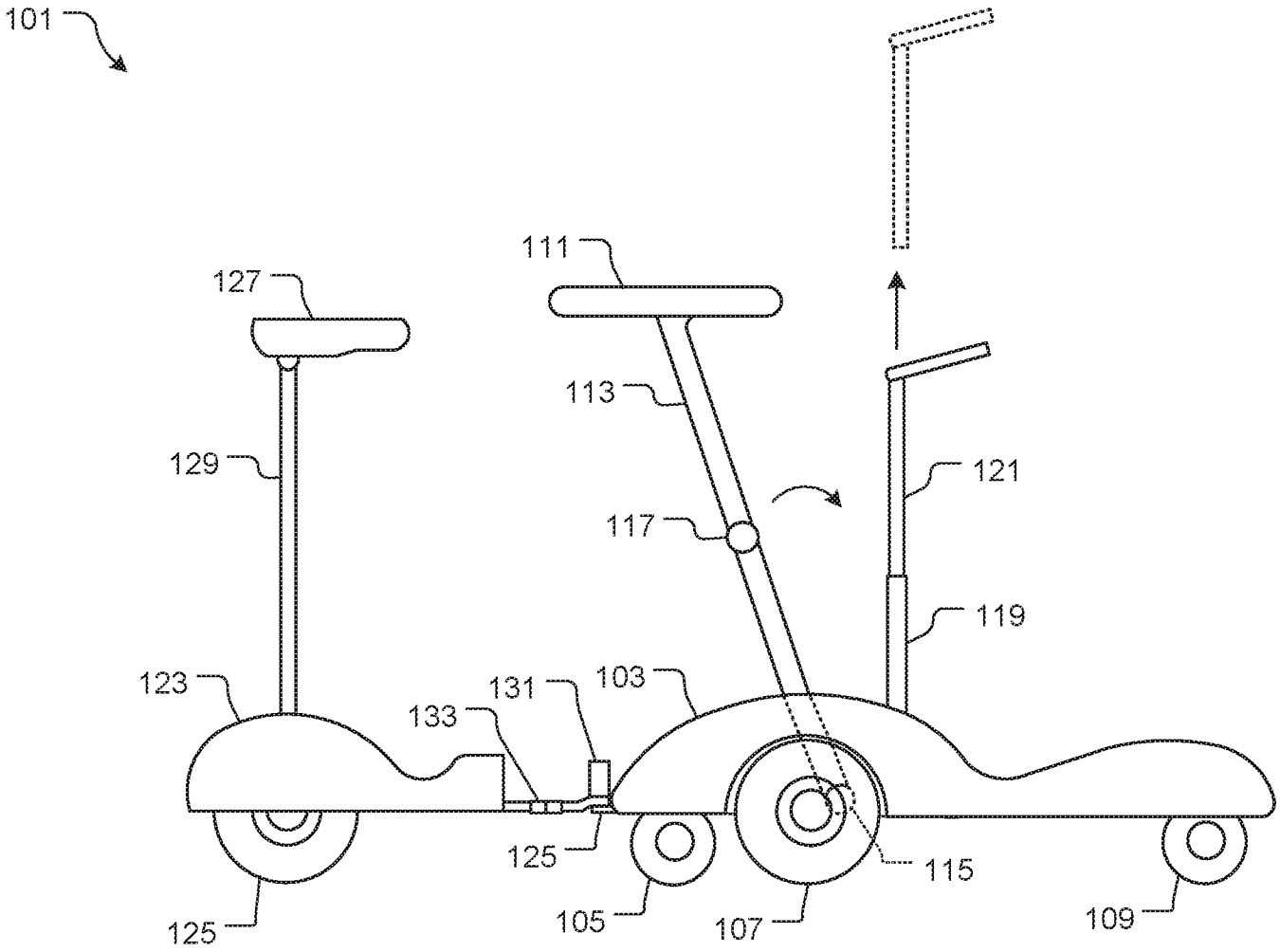
FIG. 1 is a side view of a mobility cart in a first orientation in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional personal transportation systems. Specifically, the present invention provides for a system that is lightweight, environmentally friendly, and versatile, thereby being convenient for one or more users in multiple scenarios. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
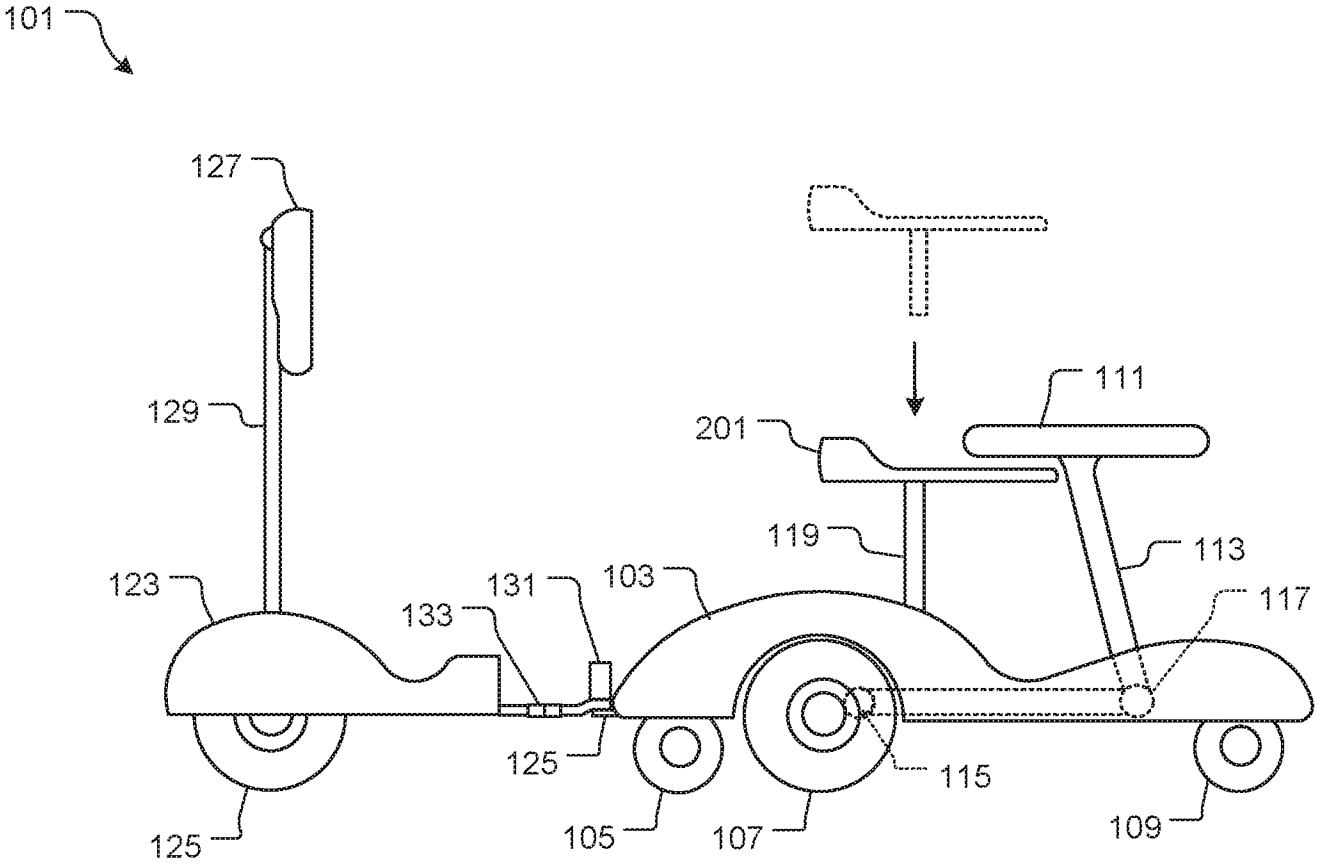
FIG. 2 is a side view of the mobility cart in a second orientation in accordance with the preferred embodiment of the present application.
Figure 3:
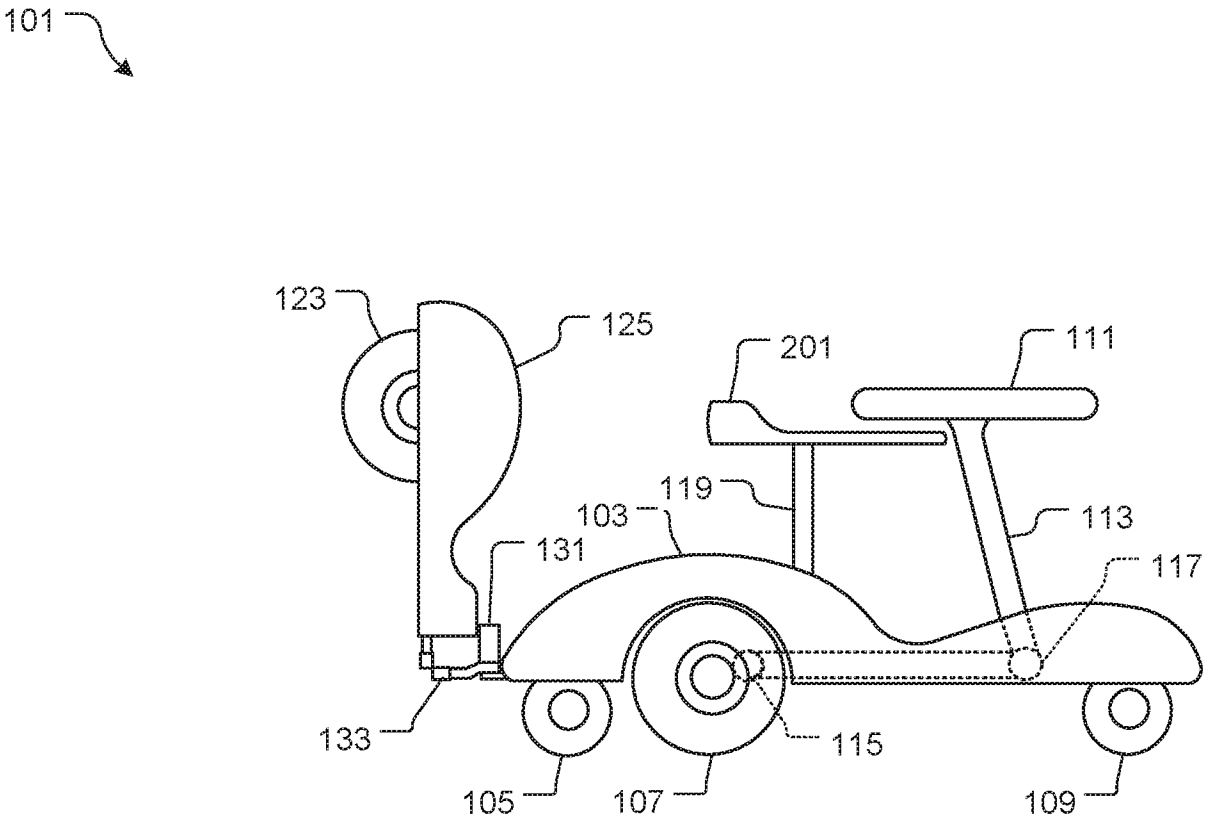
FIG. 3 is a side view of the mobility cart in a third orientation in accordance with the preferred embodiment of the present application.

Referring now to the drawings wherein like reference characters identify corresponding or similar elements throughout the several views, FIGS. 1-3 depict side views of a mobility cart system 101 in various orientations in accordance with a preferred embodiment of the present application. It will be appreciated that system 101 provides one or more benefits over conventional personal mobility systems.

In the contemplated embodiment, system 101 includes a first platform 103 with a plurality of wheels 105, 107, 109 configured to engage with a ground surface. It should be appreciated that the first platform 103 can vary in shape and size, however, it should be appreciated that the first platform is lightweight and can easily be carried and transported by the user.

System 101 further including a first control console 111 with a first support 113 attached to the platform 103 and extending therefrom. As shown in the various views, in the preferred embodiment, the first support 113 is attached at a pivot joint 115 to the platform, and further includes a second pivot joint 117 that allows for the control console 111 to pivot from a first position to a second (see FIG. and 2). This allows for various positioning of the controls as could be needed by the user.

As shown in FIGS. 1 and 2, a second support 119 can be attached to and extend from the platform 103, the second support 119 being configured to support one or more apparatuses. For example, as shown in FIG. 1, in one orientation, a bag support 121 can be removably engaged with second support 119, thereby allowing for a user to place their bag or other article conveniently for transportation. However, as a second example, as shown in FIG. 2, a seat 201 can be removably engaged with support 119, thereby allowing for a user to have a seat, while using control console 111.

It should be appreciated that the user can utilize system 101 with the features described above, however, as desired, a second platform 123 for a second user can be attached via a hitch 125. Second platform 123 again having one or more wheels 125 and being composed of lightweight materials. As shown, a second seat 127 can be supported via a third support 129 to allow for a second user to sit. As shown, the seat 127 can be configured to pivot downward for storage.

System 101 can further include a cylinder 131 which can be configured to support one or more accessories, as will be discussed herein.

In FIG. 3, a third orientation is shown, wherein the seat 127 is removed and the second platform 123 is pivoted into an upright position via a hinge 133. It should be appreciated that this allows for a user to keep the second platform 123 available for use, while keeping the platform 123 pivoted upwards and out of the way until needed.

It should be appreciated that one of the unique features believed characteristic of the present application is the various features that allow a user to customize the cart per their needs. For example, the ability of the cart to be configured for one or two people, the ability of the user to fold and reconfigure the control console, and the ability to add accessories all provide for an improved transportation system.

Figure 5:
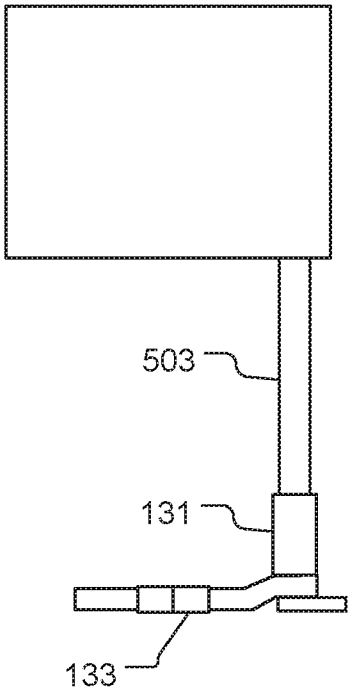
FIG. 5 is a side view of a second example of an accessory for adding to the mobility cart of the present application.
Figure 4:
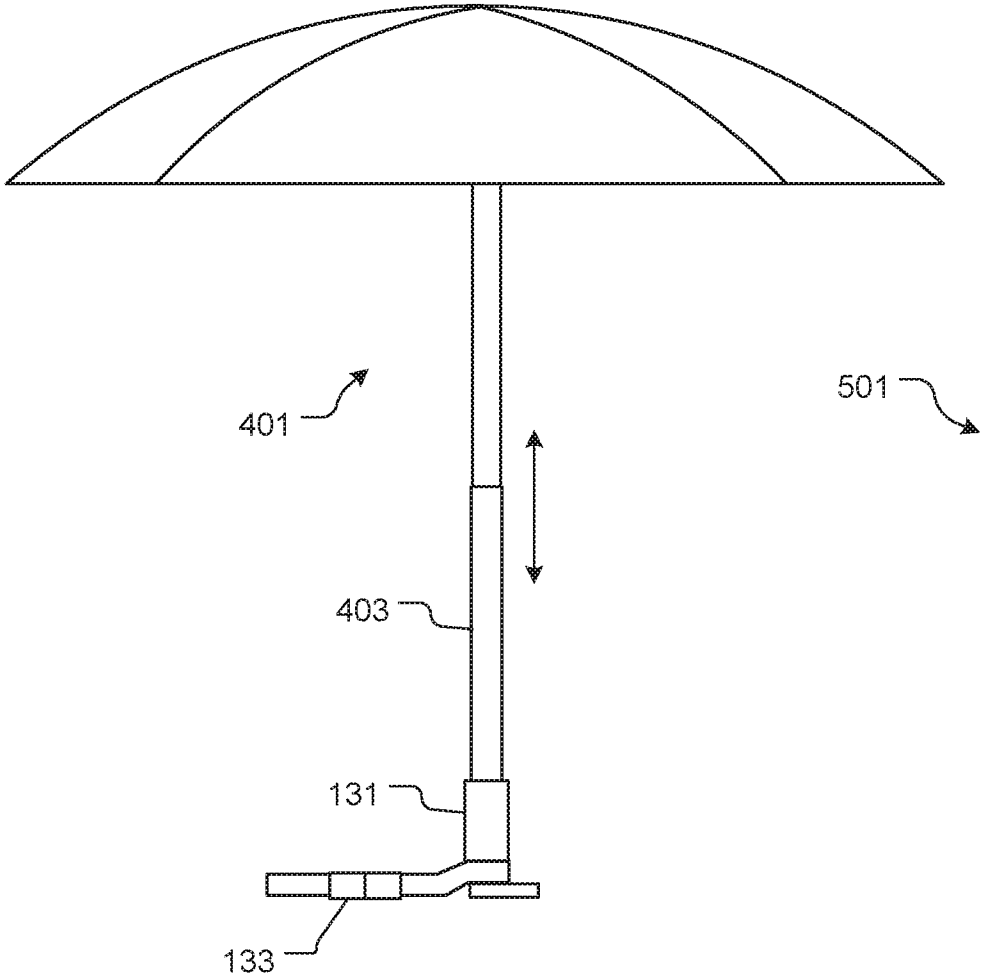
FIG. 4 is side view of a first example of an accessory for adding to the mobility cart of the present application.

In FIGS. 4 and 5, two side views depict two examples of accessories that can be used in connection with the present application. As shown in FIG. 4, it is contemplated that an umbrella 401 can be secured in cylinder 131 via an adjustable support 403. As shown in FIG. 5, it is contemplated that a basket 501 can be secured in cylinder 131 via a support 503. It should also be appreciated that in some embodiments a basket 501 can be placed inside/on top of the second platform, thereby providing for additional cargo transport. Again, it should be appreciated that the various accessories can be adjusted in materials, form, and style based on user needs and aesthetics.

Figure 6:
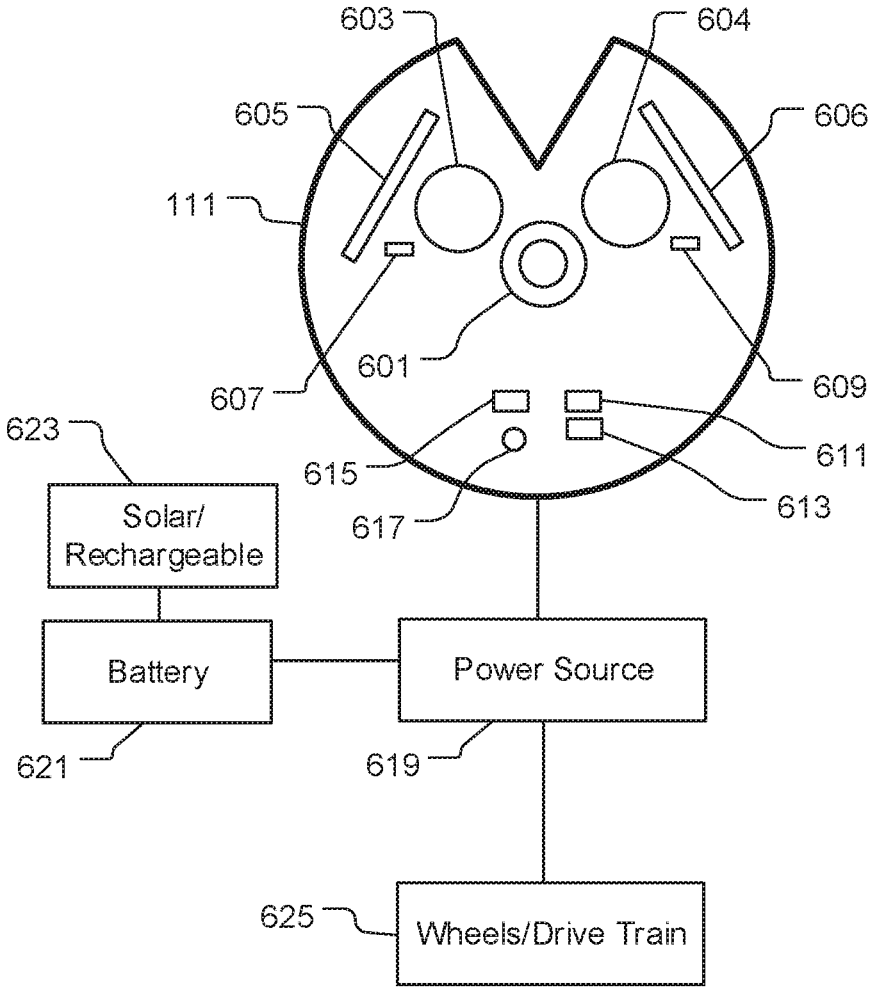
FIG. 6 is a schematic of the control features of the mobility cart of the present application.

In FIG. 6 a schematic depicts control features in accordance with the present application. It should be appreciated that the exact configuration of the control console 111 can vary, however, as shown, in one embodiment, the control console 111 includes a control stick 601 configured to provide directional control of the first and second platforms; one or more speakers 603, 604 such as for playing music or talking on the phone; one or more electronic device holders 605, 606 for supporting a phone/tablet or the like; one or more USB ports 607, 609 such as for charging an electronic device; a digital low tire light 611; a battery status 613; a speed indicator 615; and a key switch 617.

As further shown, it should be appreciated that the system includes a power source 619 which can vary. In some embodiments, the power source is a battery 621 which can be solar and/or rechargeable 623, thereby providing for energy efficiency. As shown, the control console and power source are configured to operate the motion of the cart via the wheels/drive train 625.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A mobility cart system, comprising:

a first platform with a plurality of wheels extending therefrom and configured to engage with a ground surface;

a first control console with a first support attached to and extending from the first platform, the first control console is pivotally attached and foldable relative to the first platform, the first support is pivotally attached to the first platform and is configured to partially fit within the first platform while in a folded position;

a first seat attached to and extending from the first platform, the first seat is removably attached to the first platform and configured to support a first user;

a power source configured to provide traversing movement of the first platform via the plurality of wheels;

a cylinder secured to the first platform;

an accessory movably attached to the cylinder;

a second platform movably attached to the first platform via a hitch and configured to pivot and rotate relative to the first platform via a hinge; and a second seat removably secured to the second platform, the second seat is configured to support a second user;

wherein the first platform is configured to support a first user.

2. The system of claim 1, wherein the first control console further comprises:

a control stick configured to provide directional control of the first platform from the first user;

one or more speakers;

one or more electronic device holders;

one or more USB ports;

a digital low tire light;

a battery status;

a speed indicator; and a key switch.

3. The system of claim 1, wherein the accessory is an umbrella.

4. The system of claim 1, wherein the accessory is a carry basket.

* * * * *